US005102455A

United States Patent [19]

Allen et al.

[11] Patent Number: 5,102,455

[45] Date of Patent: Apr. 7, 1992

[54] AGGLOMERATION OF PARTICULATE MATERIAL EMPLOYING A POLYMER

[75] Inventors: Anthony P. Allen; John R. Field, both of West Yorkshire, England

[73] Assignee: Allied Colloids Limited, England

[21] Appl. No.: 568,299

[22] Filed: Aug. 16, 1990

[30] Foreign Application Priority Data

Aug. 18, 1989 [GB] United Kingdom ..... 8918913

[51] Int. Cl.[5] ..... C22B 1/244

[52] U.S. Cl. ..... 75/772; 427/221

[58] Field of Search ..... 75/767, 772; 427/221

[56] References Cited

U.S. PATENT DOCUMENTS 4,684,549 8/1987 Allen et al. ..... 75/767

4,767,449 8/1988 Rosen et al. ..... 75/772

*Primary Examiner*—Melvin J. Andrews

*Attorney, Agent, or Firm*—Ostrolenk, Faber, Gerb & Soffen

[57] ABSTRACT

Particulate material such as iron ore is agglomerated into pellets or other agglomerates by being homogeneously mixed in the presence of moisture with a binder followed by agglomeration of the moist mixture, and the binder comprises a water soluble anionic polymer having intrinsic viscosity of from about 2 to about 7 dl/g and containing 5 to about 20% by weight carboxylic monomer groups (measured as sodium salt). The preferred polymer of is the copolymer of acrylamide and 5 to 20%, preferably 5 to 15%, sodium acrylate. The binder may also comprise bentonite.

16 Claims, No Drawings

AGGLOMERATION OF PARTICULATE MATERIAL EMPLOYING A POLYMER

This invention relates to the formation of agglomerates of particulate material that is water insoluble and non-swellable in water and that generally is a metallurgical ore, such as iron ore.

It is well known to convert particulate iron ore (or other particulate material that is insoluble and non-swelling in water) to bonded agglomerates by mixing it with a binder in the presence of water and forming the moist mixture into agglomerates, which are then dried and fired. Suitable methods are described in EP 225171 and EP 0288150 and in U.S. Pat. Nos. 4,767,449 and 4,802,914, and the prior art referred to in those documents.

In particular, EP 225171 proposed the use of a finely powdered polymer having intrinsic viscosity (IV) of 3 to 16 dl/g formed from a monomer blend containing 5 to 60% by weight monomers. In all the examples the amount of anionic monomer (sodium acrylate) was at least 35% and in most of the examples the polymer had IV 6.9 or higher, although a polymer of IV 3.6 containing 40% sodium acrylate was mentioned in example 3. It was stated that the preferred amount of sodium acrylate was 30 to 50% and the preferred IV was 5 to 8 dl/g. In EP 0288150 the use of anionic polymers having very much higher IV values was described. All these polymers were introduced as dry powders.

U.S. Pat. Nos. 4,767,449 and 4,802,914 emphasise mainly the use of polymers that are in the form of emulsions or dispersions, but they also mention use of powdered polymers. The anionic polymers used in these patents also have high IV values. For instance the powdered polymers in Table II of U.S. Pat. No. 4,802,914 all have IV values above 15 and the anionic emulsion polymers in Table I of U.S. Pat. No. 4,802,914 all have values in the range IV 10 up to IV 23. That table also mentions a lower molecular weight polymer, IV 5.8, which is non-ionic.

Although the binder can consist solely of such a polymer (optionally mixed with inorganic salts such as sodium carbonate), in some instances the binder also includes bentonite e.g. as described in U.S. Pat. No. 4,767,449 and in Lang U.S. Pat. No. 3860414. The natural way to incorporate a binder comprising both bentonite and polymer is to add them substantially simultaneously at the same point of addition.

Although it is possible to obtain good results with the known binders, various practical difficulties can be encountered in commercial utilisation of them. For instance, when adding high molecular weight anionic powdered polymer the results are very dependent upon the precise amount of water that is present in the mixture. Even very small variations in water content from one part of the mixture to another can result in major variations in the performance properties of the agglomerates, and this is unsatisfactory.

Another problem is that some or all of the agglomerates may have unsatisfactory surface properties. Thus one tendency is for the agglomerates to have surfaces which tend to give cracking and/or dusting. This can be caused by the surfaces being too dry during manufacture even though the correct amount of water might have been present in the total mixture. This can be due to moisture being undesirably held within the core of each agglomerate or due to premature evaporation from the surface. An opposite effect is that the agglomerates may have surfaces that are too sticky during manufacture. This may cause dust to stick to the agglomerates, with subsequent release of the dust, or it may cause agglomerates to stick together during mixing or, in particular, in the furnace during firing. These problems can result in undesirable loss of dust into the environment and reduced permeability of the burden in the furnace.

Another problem that can occur is for the pellets to be too weak, and in particular for them to have a dry strength that is too low even though the other properties such as green strength and drop number) may be satisfactory.

A particular problem arises when the polymer is being used simultaneously with bentonite since the performance properties obtained with such mixtures are not as good as one would expect. This suggests that either or both of the components are performing less efficiently than would be desirable.

We have now surprisingly found that if the anionic polymer has both relatively low molecular weight and relatively low ionic charge then improved results are obtained (especially when the polymer is incorporated dry), both when the polymer is used alone and, in particular, when it is incorporated simultaneously with bentonite. This combination of relatively low IV and relatively low anionic charge has not previously been disclosed. The polymers used previously have always had higher IV or higher ionic charge or both.

According to the invention, particulate material that is insoluble and non-swelling in water is mixed with substantially dry binder in the presence of moisture to form a substantially homogenous mixture and is bonded into agglomerates, and the binder comprises a water soluble anionic polymer made from a water soluble blend of non-ionic ethylenically unsaturated monomer and ethylenically unsaturated carboxylic monomer, the polymer has intrinsic viscosity of about 2 to about 7dl/g, and the amount of ethylenically unsaturated carboxylic monomer (measured as sodium salt) is about 5 to about 20% by weight of total monomers from which the polymer is made.

The binder is substantially dry and so its introduction has little or no effect on the total water content of the mix. As a result the polymer cannot conveniently be introduced as a solution.

The polymer can be introduced as a dispersion, for instance a dispersion in oil of dry or (less preferably) aqueous polymer particles. Such dispersions conveniently are made by reverse phase polymerisation, optionally followed by azeotropic distillation. Preferably however the polymer is added as a powder.

The particles of the powder can be relatively large, for instance up to 1000 μm or possibly more but preferably they are substantially all below 500 μm and preferably substantially all below 300 μm. The particles are preferably above 20 μm to minimise handling probelms, often being substantially all in the range 20 to 200 μm. Best results are often achieved when substantially all (for instance at least 90% by weight) are in the range 20 to 150 μm or, preferably, 20 to 100 μm. These are the particle sizes of the individual polymer particles. These individual particles may be introduced into the mixture as friable aggregates of several particles, these aggregates breaking down into the individual particles during mixing with the insoluble particulate material.

The polymer may be made by polymerisation in conventional manner. For instance particulate polymer may be made by reverse phase polymerisation followed by drying and, optionally, comminution or it may be made by bulk gel polymerisation followed by drying and comminution. Preferably it is in the form of beads made by reverse phase polymerisation.

The polymer must be made from a blend of non-ionic and anionic monomers. If there is more than 95% by weight non-ionic monomer in the blend, the polymer will tend to absorb water too slowly and will give inferior results. At least 5% by weight of the monomers should be ethylenically unsaturated carboxylic monomer.

The preferred non-ionic monomer is acrylamide but other water soluble non-ionic ethylenically unsaturated monomers can be used, generally in combination with acrylamide. The preferred carboxylic monomer is acrylic acid but other ethylenically unsaturated carboxylic acid can be used, generally in combination with acrylic acid.

It is also possible to include other anionic monomers, or even cationic monomers, with the defined non-ionic and carboxylic monomers but the amounts of them should be sufficiently low that they do not deleteriously affect the performance properties and generally the amount of any such termonomer will be below the amount of carboxylic monomer, and preferably these other termonomers are wholly absent.

If the amount of carboxylic monomer is above 20% the performance of the polymer is inferior and in particular the surface properties of the agglomerates will be less satisfactory. It is generally preferred that the amount of carboxylic groups should be below 20%, and preferably is in the range 5 to 15%, with best results generally being obtained at around 10%. These amounts are by weight of total monomers calculated on the sodium salt. The carboxylic acid is normally introduced as the sodium salt but it can be introduced in the form of other water soluble salts such as the ammonium or potassium salts or in some instances it can be used partially or wholly in the form of free acid.

When polymerising the relevant monomers it is not always possible to obtain exactly the IV that is desired. Since it is essential in the invention that the IV should be moderate or low it is therefore desirable to aim at an IV of about 6 or 6.5 as a maximum so that the actual IV of the polymer is not more than about 7 dl/g (e.g. up to 7.2 dl/g) and preferably is below 6.5 or 6 dl/g. In general, results improve as the IV is reduced (provided it is not too low) and so the IV is preferably below 5 dl/g and most preferably is not more than about 4 dl/g. Values of around 3 or 3.5 dl/g are often particularly suitable.

If the intrinsic viscosity is too low the green strength properties will become inferior and so intrinsic viscosity must be at least 2 dl/g and generally at least 2.5 dl/g and often it is at least 3 dl/g.

In this specification, IV is determined using a suspended level viscometer at 25° C. in 1 molar NaCl buffered to pH 7.

Preferred polymers for use in the invention are copolymers of 95 to 85% by weight acrylamide and 5 to 15% by weight sodium acrylate having intrinsic viscosity of from about 2.5 or 3 up to 6.5 or 7 dl/g, preferably up to 4.5 or 5 dl/g.

It is therefore essential in the invention to have a combination of moderate to low IV and moderate to low anionic content. This selection is in contrast to all the specific teachings in the prior art. There is no suggestion in the prior art that there is any benefit from having a moderately low anionic content and the only specific example in the prior art of the use of polymers having these moderately low anionic content are always of polymers having high IV. Reference can be made to, for instance, Tables 1 and 2 of U.S. Pat. No. 4,767,449. Percol 725 mentioned in Table 2 has IV above 15. Similarly, the only specific suggestion of a moderately low IV anionic polymer (Example 3 of U.S. Pat. No. 4,684,549) has high anionic content. By reducing anionic content and/or IV below the normal, and preferably by reducing both, it seems that the aqueous phase that is formed during the process has improved viscosity characteristics. In particular it will have significantly less viscosity than would be the case at higher intrinsic viscosity values and higher anionic content values. Because of the reduced viscosity, the process seems to be less sensitive to minor variations in water content, and thus a more uniform product is obtained despite possible variations in the moisture content of the particulate material that is being agglomerated.

However, as the result of ensuring that the intrinsic viscosity and anionic content are not both too low, the aqueous phase has a viscosity that is sufficiently high to give useful performance properties.

By the invention, it is possible to avoid the cracking and dusting problems that can arise when using higher anionic and/or higher IV polymers. In particular it is possible to obtain pellets having a more regular spherical shape and size. Also, it is possible to obtain improved dry strength.

The amount of polymer that is used is preferably in the range about 0.005 to 0.2% by weight of the material that is being agglomerated. Usually the amount is at least about 0.01% but preferably it is not more than about 0.1%.

The polymer is preferably used in combination with other pelletising additives such as sodium carbonate, sodium bicarbonate or any of the other inorganic or other additives proposed for this purpose in, for instance the aforementioned U.S. patents. The amount of these inorganic additives is typically from 0.2 to 2 parts by weight per part by weight water-soluble polymer.

The binder can also include bentonite. The amount of bentonite can be in the conventional range for pelletising, for instance up to 1% based on the weight of material to the agglomerated. Preferably, however, the amount of bentonite is less than would be used in the absence of the polymer and so the amount is preferably below 0.5%, typically in the range 0.05 to 0.5%, preferably 0.05 to 0.3%, based on the weight of material being agglomerated.

The benefit of the invention is particularly marked when bentonite is used as part of the binder and, in particular, when the bentonite and polymer are added to the insoluble particulate material at substantially the same time. By this we mean that they are added without any deliberate pre-mixing and equilibration of one into the particulate material before adding the other. When adding dry bentonite with the polymer (which is preferably in the form of powder) it is particularly preferred to have the anionic content reduced, e.g to 5 to 15%, but it is also useful to have the IV reduced, e.g. to a value of from 2.5 to 4 dl/g.

We believe that the success of the invention when bentonite is added with polymer is because the polymer absorbs the water more slowly and/or makes the water more readily available to the bentonite than when higher IV and higher anionic content polymers, are used. With these higher IV and/or higher anionic polymers we believe there is a tendency for the water to be absorbed preferentially by the polymer particles with the result that the bentonite absorbs insufficient water to allow it to function properly as a binder.

Accordingly the method of the invention gives significant advantages over the method of, for instance, U.S. Pat. No. 4,767,449 where high IV polymers that usually have high anionic content are mixed substantially simultaneously with bentonite.

The material that is to be agglomerated in the invention should preferably have small particle size, typically below 250 μm. It can be organic such as carbon or coal but is preferably inorganic and most preferably is a metallurgical ore, especially iron ore. Thus the invention is of particular value in iron ore pelletisation processes.

The general method of conducting the agglomeration process can be conventional, as described in any of the above mentioned patents. Thus the polymer is mixed with the particulate material (and with any additional binder components) and with any additional water that is required to bring the moisture content to the optimum level for that particular mix (typically 5 to 15%, preferably 9 to 12%, for iron ore), and after thorough mixing the mixture is agglomerated into pellets, briquettes or other appropriate shape. The additional water, if any, is usually added as a spray. Agglomeration is preferably conducted without compression and generally is by balling either on a disc or, more usually, in a balling drum. The final particle size is often in the range 5 to 16 mm. The particles are then dried and fired, typically at a temperature up to 1200° C, in known manner and as described in the aforementioned patents.

The following are examples.

Pellets of iron ore were made by the general technique described in EP 225171 but using, as binder, 0.268% bentonite and a blend of 0.0134% sodium carbobate and 0.0134% powdered polymer made by reverse phase bead polymerisation to form powdered beads having a particle size below 150 μm. The polymers used, polymers A to K, were formed of acrylamide and sodium acrylate, and had IV, as shown in the following Table:

| Polymer | IV (dl/g) | % Na Acrylate | % Acrylamide |
|---|---|---|---|
| A | 9-11 | 34 | 66 |
| B | 5-7 | 34 | 66 |
| C | 5-7 | 20 | 80 |
| D | 6.6 | 20 | 80 |
| E | 6.6 | 15 | 85 |
| F | 6.0 | 10 | 90 |
| G | 7.1 | 5 | 95 |
| H | 3.7 | 20 | 80 |
| I | 3.4 | 15 | 85 |
| J | 3.4 | 10 | 90 |
| K | 3.5 | 5 | 95 |

In each instance, bentonite and polymer was added substantially simultaneously to the moist particulate iron ore that was being pelletised. Pelletisation was completed in conventional manner. The following results were obtained.

| Polymer | Green Strength/kg | Dry Strength/kg | Drop Number | % Moisture |
|---|---|---|---|---|
| A | 1.19 | 0.98 | 4.5 | 9.9 |
| B | 1.14 | 0.88 | 4.9 | 9.8 |
| C | 1.04 | 1.00 | 7.1 | 9.8 |
| D | 1.09 | 1.06 | 22.2 | 10.2 |
| E | 1.06 | 1.25 | 12.0 | 10.1 |
| F | 1.30 | 1.68 | 14.1 | 9.9 |
| G | 1.24 | 1.36 | 10.9 | 9.8 |
| H | 1.03 | 1.51 | 14.9 | 10.4 |
| I | 1.11 | 1.68 | 14.1 | 10.2 |
| J | 1.11 | 1.91 | 14.7 | 10.1 |
| K | 0.97 | 1.29 | 11.2 | 9.3 |

It is clear from these results that the polymers having IV around 6 to 7 give better dry strength when the sodium acrylate content is 5 to 15% than when it is 20%, and that the polymers having lower IV again give improved dry strength, even when the sodium acrylate content is 20%. The numerical performance value of polymers C and D (IV close to 7 and 20% sodium acrylate) are only slightly better than the comparison polymers A and B. However, examination of the pellets made using polymer C clearly demonstrates that they have a much better shape and regularity in shape and size, and less dusting, than is obtainable using polymers A and B.

We claim:

1. In a method comprising mixing particulate material that is insoluble and nonswelling in water with substantially dry binder in the presence of moisture to form a substantially homogeneous mixture which is bonded into agglomerates, in which the binder comprises a water-soluble anionic polymer made from a water soluble blend of non-ionic ethylenically unsaturated monomer and ethylenically unsaturated carboxylic monomer, the improvement which comprises employing a polymer which has intrinsic velocity (IV) of about 2 to about 7 dl/g and in which the amount of ethylenically unsaturated carboxylic monomer (measured as sodium salt) is about 5 to 20% by weight of total monomers from which the polymer is made.

2. A process according to claim 1 in which the polymer has IV of 2 to 5 dl/g.

3. A process according to claim 1 in which the amount of carboxylic monomer is 5 to 15%.

4. A process according to claim 1 in which the polymer has IV of 2 to 5 dl/g and the amount of carboxylic monomer is 5 to 15%.

5. A process according to claim 1 in which the polymer is added in the form of free flowing powder particles that are either substantially all of a size up to 300 μm or are disintegratable aggregates of particles substantially all of a size up to 300 μm.

6. A process according to claim 5 in which the particles of a size up to 300 μm are particles of which at least 90% by weight are in the range 20 to 150 μm.

7. A process according to claim 1 in which the polymer is a copolymer of acrylamide and sodium acrylate.

8. A process according to claim 1 in which the particles that are insoluble and non swelling in water are particles of metallurgical ore.

9. A process according to claim 1 in which the binder includes inorganic salt selected from sodium bicarbonate and sodium carbonate.

10. A process according to claim 8 in which the binder also includes bentonite.

11. A process according to claim 8 in which the binder also includes bentonite, and the bentonite and the water soluble polymer are mixed substantially simultaneously with the metallurgical ore.

12. In a process in which iron ore pellets are made comprising adding substantially dry binder comprising bentonite and powdered organic polymer to particulate iron ore in the presence of moisture to form a homogeneous mixture and agglomerating the mixture into pellets, the improvement which comprises adding the bentonite and polymer substantially simultaneously to the particulate iron ore, and employing a polymer which is a water soluble anionic polymer made from a water soluble blend of nonionic ethylenically unsaturated monomer and about 5 to about 20% (by weight measured as the sodium salt) of ethylenically unsaturated carboxylic monomer and which has intrinsic viscosity of about 2 to about 7 dl/g, and which is in the form of powder particles that are either substantially all of a size up to 300 μm or are disintegratable agglomerates of particles substantially all of a size up to 300 μm.

13. A process according to claim 12 in which the amount of anionic monomer is 5 to 15%.

14. A process according to claim 12 in which the polymer is a copolymer of acrylamide and sodium acrylate.

15. A process according to claim 12 in which the polymer has IV 2 to 5.

16. In a method comprising mixing particulate material that is insoluble and nonswelling in water with substantially dry binder in the presence of moisture to form a substantially homogeneous mixture which is bonded into agglomerates, in which the binder comprises a water-soluble anionic polymer made from a water soluble blend of non-ionic ethylenically unsaturated monomer and ethylenically unsaturated carboxylic monomer, the improvement which comprises employing as the polymer a copolymer of arcylamide and 5 to 15% based on the weight of the total monomers of sodium acrylate having an intrinsic viscosity of 2 to 5 dl/g in the form of free flowing powder particles that are either substantially all of the size up to 300 μm or are disintegratable aggregates of particles substantially all of the size up to 300 μm.

* * * * *